US008428496B2

(12) United States Patent
Izawa et al.

(10) Patent No.: US 8,428,496 B2
(45) Date of Patent: Apr. 23, 2013

(54) WET TYPE DEVELOPING APPARATUS

(75) Inventors: Hideo Izawa, Narashino (JP); Junichi Setoyama, Narashino (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 299 days.

(21) Appl. No.: 12/838,132

(22) Filed: Jul. 16, 2010

(65) Prior Publication Data

US 2011/0013942 A1 Jan. 20, 2011

(30) Foreign Application Priority Data

Jul. 17, 2009 (JP) ..... 2009-168748

(51) Int. Cl.
*G03G 15/10* (2006.01)

(52) U.S. Cl.
USPC ..... 399/239; 399/120

(58) Field of Classification Search ..... 399/120, 399/121, 222, 237–248
See application file for complete search history.

(56) References Cited

U.S. PATENT DOCUMENTS 5,387,760 A * 2/1995 Miyazawa et al. ..... 399/239
6,134,409 A 10/2000 Staples et al.
6,904,254 B2 * 6/2005 Yoshino ..... 399/237
2003/0138271 A1 7/2003 Cho et al.

FOREIGN PATENT DOCUMENTS

GB 1 333 422 10/1973
JP 2008-299065 12/2008

* cited by examiner

*Primary Examiner* — Hoan Tran
(74) *Attorney, Agent, or Firm* — Cozen O'Connor

(57) ABSTRACT

A wet type developing apparatus in which liquid developer is fed onto a developing roller from a liquid developer supply roller immersed in the developing liquid within a liquid developer tank and an electrostatic latent image formed on a photoconductor drum and developed into a toner image by the developing roller is improved to enable the liquid developer to be fed an appropriate amount of feed from the liquid developer supply roller onto the developing roller without residual air in the surface region of the liquid developer supply roller, where a partition plate is disposed generally under the liquid developer supply roller within the liquid developer tank for partitioning the liquid developer tank in the rotational direction of the liquid developer supply roller, the partition plate having its upper end juxtaposed with a peripheral surface of the liquid developer supply roller over its total axial length across a gap spacing.

5 Claims, 4 Drawing Sheets

WET TYPE DEVELOPING APPARATUS

FIELD OF THE INVENTION

The present invention relates to a wet type developing apparatus for use in a wet type electrophotographic printer.

BACKGROUND OF THE INVENTION

In a wet type developing apparatus of this sort, a liquid developer reserved in a liquid developer tank is drawn up by a liquid developer supply roller onto a developing roller and, with the liquid developer fed on the surface of the developing roller, an electrostatic latent image formed on the surface of a photoconductor drum is developed into a toner image. And, the toner image on the photoconductor drum is transferred on a printing surface of web directly or via a transfer roller.

In a conventional wet type developing apparatus as mentioned above, use has been made of an anilox roller as the liquid developer supply roller immersed in part in the liquid developer tank. By varying the peripheral speed of the liquid developer supply roller with respect to that of developing roller, the rate of feed, or the supply, of the liquid developer onto the developing roller is varied. See, for example, JP 2008-299065 A).

In the conventional apparatus using the anilox roller in which the anilox roller is immersed in the liquid developer of the liquid developer tank to draw up the liquid developer, the problem arises that the higher the speed of rotation of the liquid developer supply roller, the more does air that has come into cells on the surface of the anilox roller fail to come out completely, and air residual in the cells of the liquid developer supply roller tends to get mixed into the liquid developer fed on the developing roller, which causes instabilizing the supply or rate of feed, of the liquid developer onto the developing roller.

SUMMARY OF THE INVENTION

One object of the present invention is to provide a wet type developing apparatus whereby without air residual on the surface of a liquid developer supply roller, the liquid developer can be fed from the liquid developer supply roller onto a developing roller at an appropriate supply or rate of feed so as to achieve an enhanced quality of images on a printed surface of web.

In order to attain the object mentioned above, the present invention in a first aspect thereof provides a wet type developing apparatus in which a liquid developer is fed onto a developing roller from a liquid developer supply roller immersed in the developing liquid within a liquid developer tank and an electrostatic latent image formed on a photoconductor drum is developed into a toner image by the said developing roller, wherein the apparatus includes: a partition plate disposed generally under the liquid developer supply roller in the liquid developer tank for partitioning the liquid developer tank into two in the direction of rotation of the liquid developer supply roller, the partition plate having an upper end juxtaposed with a peripheral surface of the liquid developer supply roller over its total axial length across a gap spacing between 0.05 and 0.5 mm.

Also, the present invention provides in a second aspect thereof a wet type developing apparatus as set forth above, wherein the peripheral speed of the liquid developer supply roller is adjustably varied relative to the peripheral speed of the developing roller to make adjustable the thickness of a film of the liquid developer fed onto the developing roller and to maintain the same between 3 and 4.8 μm.

The present invention also provides in a third aspect thereof a wet type developing apparatus as set forth above, wherein an upper end portion of the partition plate is formed on its side upstream in the rotary direction of the liquid developer supply roller with a sloping face facing a peripheral surface of the liquid developer supply roller so as to be gradually apart therefrom.

Further, the present invention provides in a fourth aspect thereof a wet type developing apparatus as set forth above, wherein the upper end of the partition plate is formed with a liquid developer supply nozzle for flushing the liquid developer towards a peripheral surface of the liquid developer supply roller over its total axial length.

According to the first aspect of the invention, the liquid developer caused to flow convectionally as the liquid developer supply roller is rotated can be squeezed through the gap between the partition plate and the peripheral surface of the liquid developer supply roller to provide the liquid developer with a pressure, thereby permitting air residual on the peripheral surface of the liquid developer supply roller to be removed under the pressure of the liquid developer whereby the liquid developer without air mixed therein is kept fed from the liquid developer supply roller onto the developing roller stably at an appropriate amount. The result is an improved quality of images on a web printed surface.

According to the second aspect of the present invention, adjusting the peripheral speed of the liquid developer supply roller makes it possible to promptly and easily adjust the thickness of a film of the liquid developer supplied onto the developing roller according to changes in printing image and other conditions and thus to obtain improved results in workability, production efficiency and printing quality and to achieve a reduction in price of a unit product. And, with a supplied film thickness of the liquid developer being made at 3 to 4.8 μm, printed images were obtained at an increased stability.

According to the third aspect of the present invention, a space that is sphenic or wedge-shaped in cross section is formed on the side upstream of the partition plate in the direction of rotation of the liquid developer supply roller and between a peripheral surface of the liquid developer supply roller and an upper portion of the partition plate. This makes it possible for the pressure of the liquid developer to be raised smoothly in this space.

Further, according to the fourth aspect of the present invention, flushing the liquid developer towards a peripheral surface of the liquid developer supply roller from an upper end of the partition plate promotes achieving the effect of removing air residual on the surface of the liquid developer supply roller.

DETAILED DESCRIPTION OF THE DRAWINGS

Figure 1:
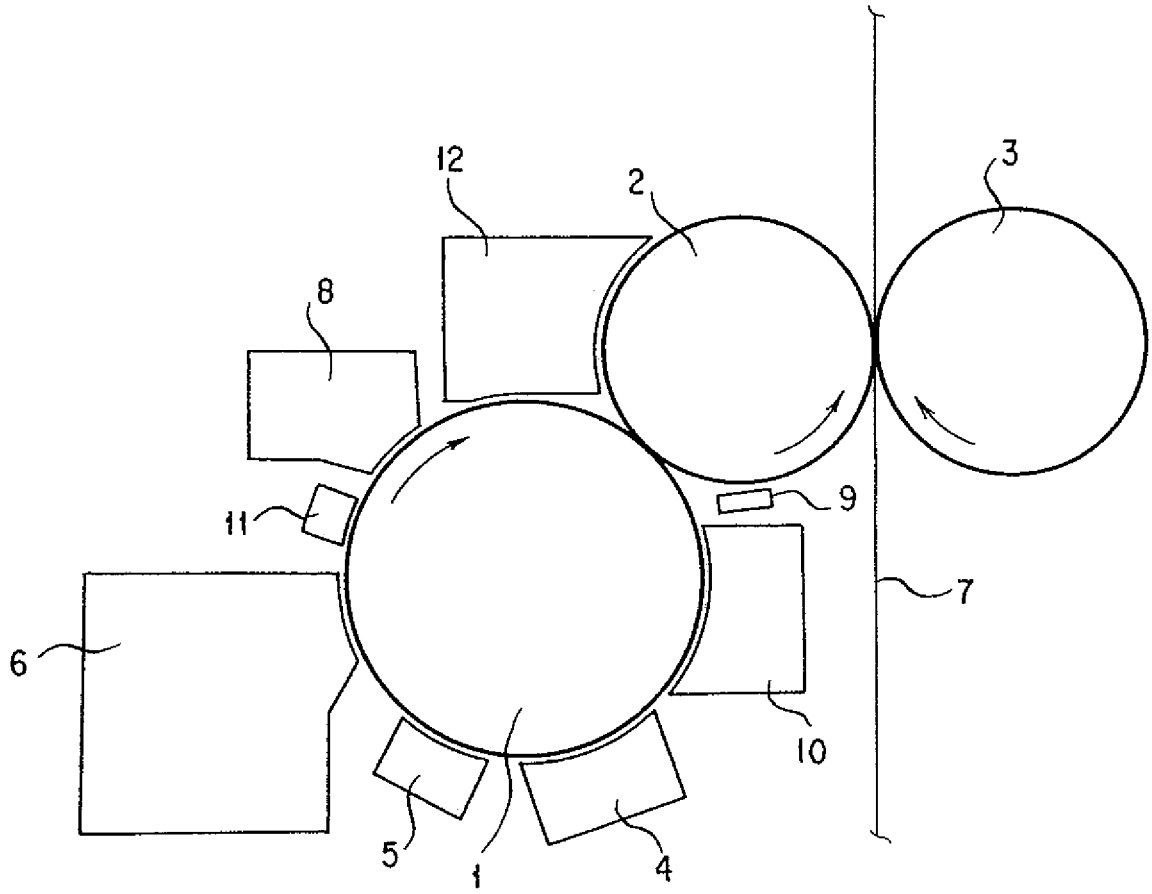
FIG. 1 is a diagrammatic explanatory view diagrammatically illustrating a wet type electrophotographic printer which is an embodiment of the present invention.

FIG. 1 is a diagrammatic explanatory view diagrammatically illustrating a wet type electrophotographic printer which is an embodiment of the present invention. As shown, a photoconductor drum 1 is in rotational contact with a transfer drum 2 which in turn is in rotational contact with a backup roll 3.

In such a wet type electrophotographic printer, the photoconductor drum 1 when in image formation thereon is rotated by a drive means such as a motor (not shown) at a fixed speed in a direction of the arrow. The surface of the photoconductor drum 1 for image formation thereon is charged uniformly in the dark by a charging unit 4 and then has an electrostatic latent image formed thereon of an original image when irradiated by an exposure unit 5. Thereafter, the electrostatic latent image is developed by a wet type developing apparatus 6 with a liquid developer made of a liquid toner, forming a toner image on the surface of the photoconductor drum 1.

The toner image formed on the surface of the photoconductor drum 1 is primarily transferred onto a surface of the transfer roller 2 under a bias voltage applied via the transfer roller 2 and a nip pressure applied between the photoconductor drum 1 and the transfer roller 2. This primarily transferred toner image is then secondarily transferred on a recording medium 7 passing between the transfer drum 2 and the backup roller 3.

Provided also around the circumference of the photoconductor drum 1 are a carrier liquid removing unit 8, a charge eliminator 9, a photoconductor drum cleaning device 10 and a set charger 11. The carrier liquid removing unit 8 is disposed downstream in position of the wet type developing apparatus 6 in the direction of rotation of the photoconductor drum 1 for removing a surplus portion of a carrier liquid of the liquid toner after development. The charge eliminator 9 is disposed downstream of the area where the photoconductor drum 1 is in rotational contact with the transfer roller 2 for removing a residual potential residual on the photoconductor drum 1 after the primary image transfer onto the transfer roller 2. The photoconductor drum cleaning device 10 acts to remove a residual toner residual on the surface of the photoconductor drum 1. And, the set charger 11 is disposed between the wet type developing apparatus 6 and the carrier liquid removing unit 8 for applying a bias voltage to the toner of the liquid toner image on the surface of the photoconductor drum 1.

Further, around the transfer roller 2 there is disposed a transfer roller cleaning device 12 downstream of the area where the transfer roller 2 is in rotational contact with the backup roller 3 in its direction of rotation.

Referring now to FIGS. 2 to 5, an explanation is given of the makeup of an essential part of the wet type developing apparatus 6.

Figure 2:
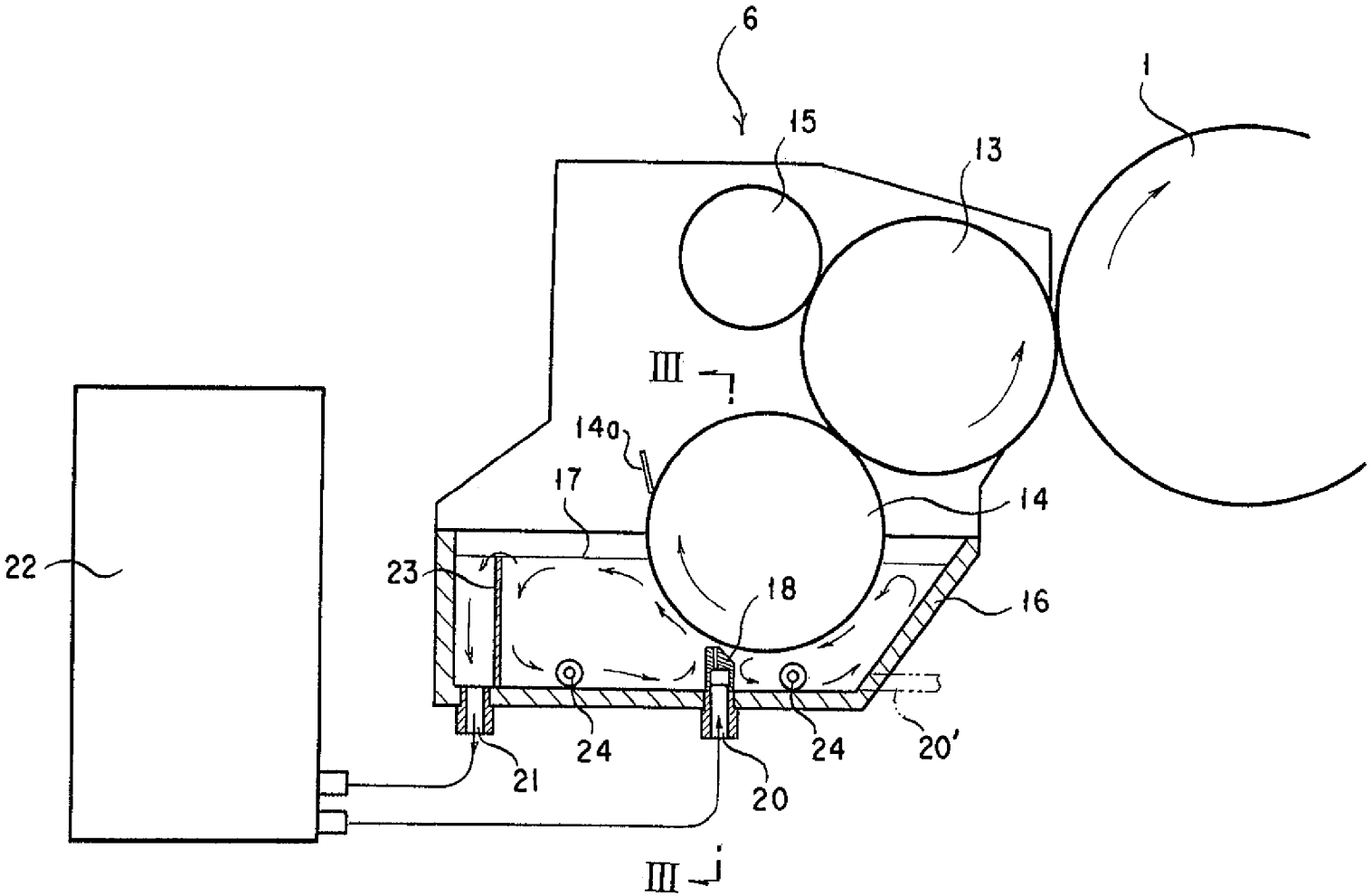
FIG. 2 is a cross sectional view in part broken diagrammatically illustrating a form of implementation of the present invention.

In FIG. 2, there are shown a developing roller 13 juxtaposed in rotational contact with the photoconductor drum 1, a liquid developer supply roller 14 in rotational contact with the developing roller 13, and a cleaning roller 15 in rotational contact with the developing roller 13. Each of these rollers 13, 14 and 15 is designed so that each of their surfaces rotationally moves in a direction identical to that of the surface of the roller with which it is in rotational contact.

As the liquid developer supply roller 14 there is used an anilox roller. A lower side of this liquid developer supply roller 14 is immersed in a liquid developer 17 reserved in a liquid developer tank 16. As the rollers rotate, the liquid developer 17 stored in cells formed on the surface of the liquid developer supply roller 14 is designed to be fed onto the developing roller 13 at a fixed rate of feed. Indicated by reference character 14*a* is a doctor blade adapted to contact the surface of the liquid developer supply roller 14.

The liquid developer tank 16 has a partition plate 18 upstanding from its bottom wall generally under the liquid developer supply roller 14 and preferably at a position shifted slightly down-stream in the rotary direction of the liquid developer supply roller 14 from the lowermost of the liquid developer supply roller 14, the partition plate 18 extending parallel to an axial direction of the liquid developer supply roller 14. The partition plate 18 is of a length over the total length of the liquid developer supply roller 14 and has its upper end spaced from the peripheral surface of the liquid developer supply roller 14 across a small gap spacing of, e.g., 0.2 mm.

Figure 4:
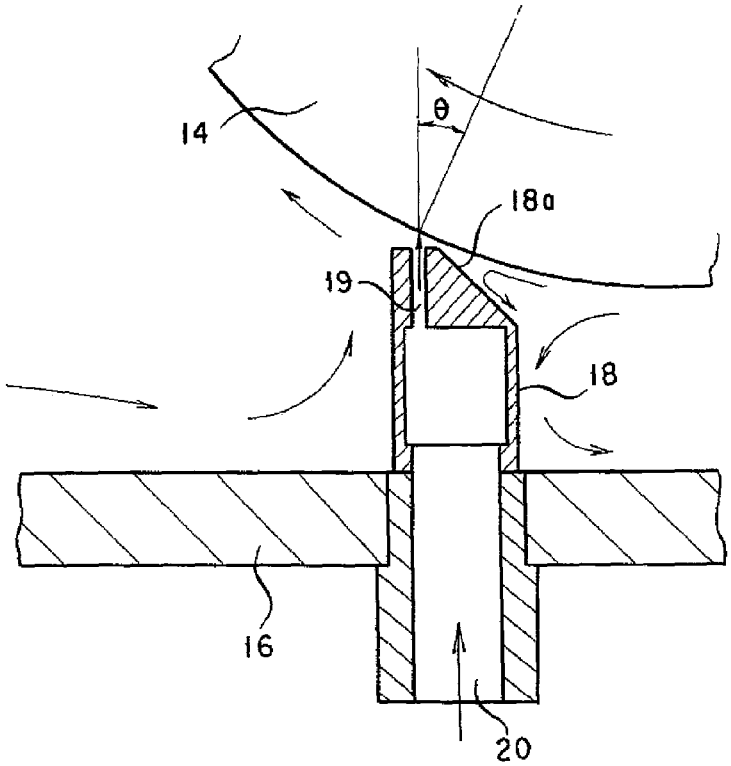
FIG. 4 is an enlarged cross sectional view illustrating a partition plate.

The upper end of the partition plate 18 is formed to be sharp in cross sectional shape. As shown in FIG. 4, it is formed on its side upstream in the rotary direction of the liquid developer supply roller 14 with a slant face 18*a* facing a peripheral surface of the liquid developer supply roller 14 so as to be gradually apart from the peripheral surface, thus forming a space sphenic or wedge-shaped in cross section between the peripheral surface of the liquid developer supply roller 14 and the upper end of the partition plate 18.

Figure 3:
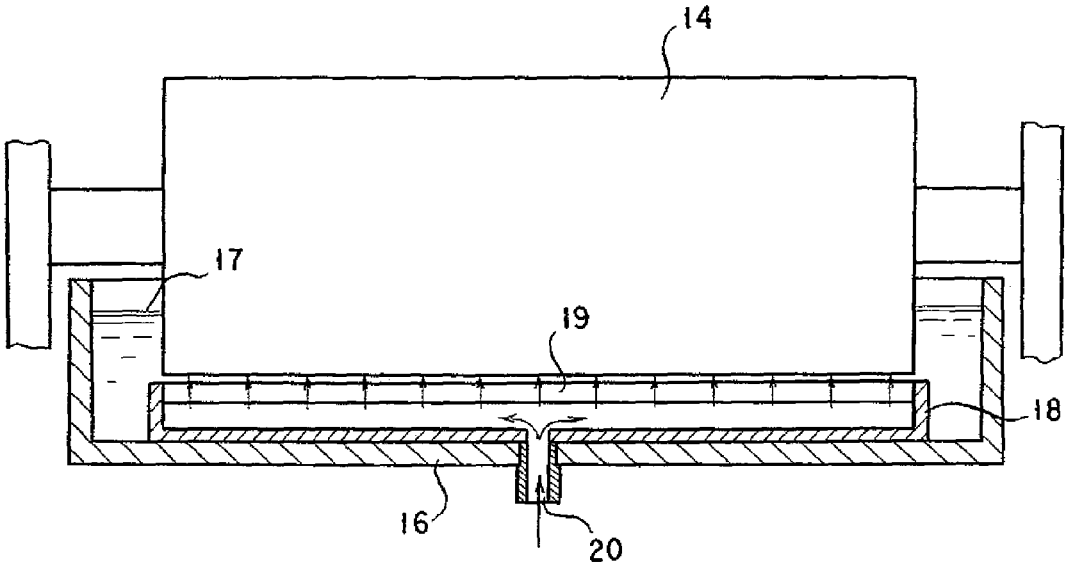
FIG. 3 is a cross sectional view taken along the line III-III in FIG. 2.

The partition plate 18 as shown in FIG. 3 is of a length that exceeds the total length of the liquid developer supply roller 14 and as shown in FIG. 2 is designed to divide the liquid developer tank 16 into two (to partition it into two compartments) in the rotary direction of the liquid developer supply roll 14. As shown in FIG. 3, a gap is provided between either end of the partition plate 18 and either side wall of the liquid developer tank 16 and through these gaps the two compartments are designed to communicate with each other on both sides of the rotary liquid developer supply roller 14.

The partition plate 18 may satisfactorily be composed of an electrically nonconductive material which is preferably a synthetic resin such that if it accidentally comes in contact with the surface of the liquid developer supply roller 14, it may not damage the surface.

In this form of implementation, the partition plate 18 as shown in FIGS. 3 and 4 is formed in its upper end portion with a liquid developer supply nozzle 19 in the form of a slit opposed to the liquid developer supply roller 14 over its total length. The liquid developer supply nozzle 19 is made to communicate with a liquid developer inlet port 20 provided through the bottom wall of the liquid developer tank 16. The bottom wall of the liquid developer tank 16 is also provided with a liquid developer return port 21 at a position spaced from, and downstream in the rotary direction of, the liquid developer supply roller 14. The developer liquid return (outlet) port 21 and the developer liquid inlet port 20 are connected to a developer liquid regenerative recycling unit 22.

In this case, positioning the partition plate 18 to lie shifted a bit downstream in the rotary direction of the liquid developer supply roller 14 as mentioned above causes the flushing opening of the liquid developer supply nozzle 19 to be opposed to the liquid developer supply roller 14 at a position a bit shifted downstream of its lowermost in the rotary direction and to flush the liquid developer in a direction inclined at an angle θ with respect to its radius. This angle θ, which can be varied by the mounting position and angle of the liquid developer supply nozzle 19, is preferably in a range between 5 and 40°.

The liquid developer tank 16 is also provided therein with a partition wall 23 upstanding between the liquid developer return port 21 and the partition plate 18 and in the vicinity of the liquid developer return port 21. Also provided in the liquid developer tank 16 are screws 24 and 24 on both sides of the partition plate 18 for stirring those portions of the liquid developer 17 in the two compartments, respectively, which are partitioned into thereby. The partition wall 23 has a height that determines the depth of the liquid developer 17 reserved in the liquid developer tank 16.

In the makeup mentioned above, the liquid developer supply roller 14 during an operation of the wet type developing apparatus 6 is rotated to keep a constant amount (constant thickness of a film) of the liquid developer 17 fed from its surface onto the surface of the developing roller 13.

Then, in the liquid developer tank 16 the liquid developer 17 as the liquid developer supply roller 14 is rotated is dragged by its peripheral surface, giving rise to convection current. At the upstream side of the partition plate 18 in the rotary direction of the liquid developer supply roller 14, the liquid developer 17 coming to be dragged by the peripheral surface of the liquid developer supply roller 14 is squeezed while it is moving along the slant face 18*a* of the partition plate 18. The liquid developer 17 is then passed through a narrow gap between the upper end of the partition plate 18 and the peripheral surface of the liquid developer supply roller 14, moving downstream of the partition plate 18.

The liquid developer 17 passing through the gap becomes higher in pressure than elsewhere by being exponentially squeezed along the slant face 18*a* of the partition plate 18, and causes the pressure to act on the surface of liquid developer supply roller 14 which is juxtaposed with the gap.

With an anilox roller used for the liquid developer supply roller 14 as mentions above, air which tends to be entrapped in cells in its surface area is removed when the peripheral surface of the liquid developer supply roller 14 is juxtaposed with the top of the partition plate 18 and the liquid developer 17 with the pressure locally increased flows into the cells.

Likewise by the action of the liquid developer 17 at the upstream side of the partition plate 18, air in the cells is removed also by the flushing pressure of the liquid developer 17 which deaerated and regulated in concentration by the liquid developer regenerative circulation unit 22 is flushed and fed towards the surface of the liquid developer supply roller 14 from the liquid developer supply nozzle 19 provided at the top of the partition plate 18.

The portion of the rotating liquid developer supply roller 14 which is immersed in the liquid developer at the downstream side of the partition plate 18 is thus held in the state that the cells in its surface area are deaerated or without air residual therein.

The liquid developer 17 downstream of the partition plate 18 in the liquid developer tank also flows convectionally as the liquid developer supply roller 14 rotates. As the liquid developer supply roller 14 rotates, the liquid developer 17 is adhered on the surface deaerated as mentioned above of the liquid developer supply roller 14 and, after made by a doctor blade 14*a* into a film of a fixed thickness, is fed onto the developing roller 13 when the liquid developer supply roller 14 is brought into rotational contact therewith.

With the liquid developer supply roller 14 made without air residual on its surface, the liquid developer 17 then fed onto the surface of the developing roller 13 is made without air mixed thereon, and in the form of a supplied film of a thickness maintained constant at a proper value is kept supplied stably.

The supplied film thickness of the liquid developer on the surface of the developing roller 13 can be adjusted by varying the peripheral speed of the liquid developer supply roller 14. The faster the relative peripheral speed, the thinner becomes the film thickness. The slower the relative peripheral speed, the thicker the film thickness. The supplied film thickness on the surface of the developing roller 13 is properly between 3 and 4.8 μm. The peripheral speed of the developing roller 14 can be varied as desired by its driving with a single motor of variable rotary speed type.

The spacing of the gap between the upper end of the partition plate 18 and the peripheral surface of the liquid developer supply roller 14 is suitably 0.2 mm as mentioned before but may practicably be in a range between 0.05 and 0.5 mm.

The partition plate 18 disposed upstanding is disposed preferably at a position shifted a bit downstream from the lowermost of the liquid developer supply roller 14 in its rotary direction, but may practicably be positioned directly under it or upstream thereof.

Figure 5:
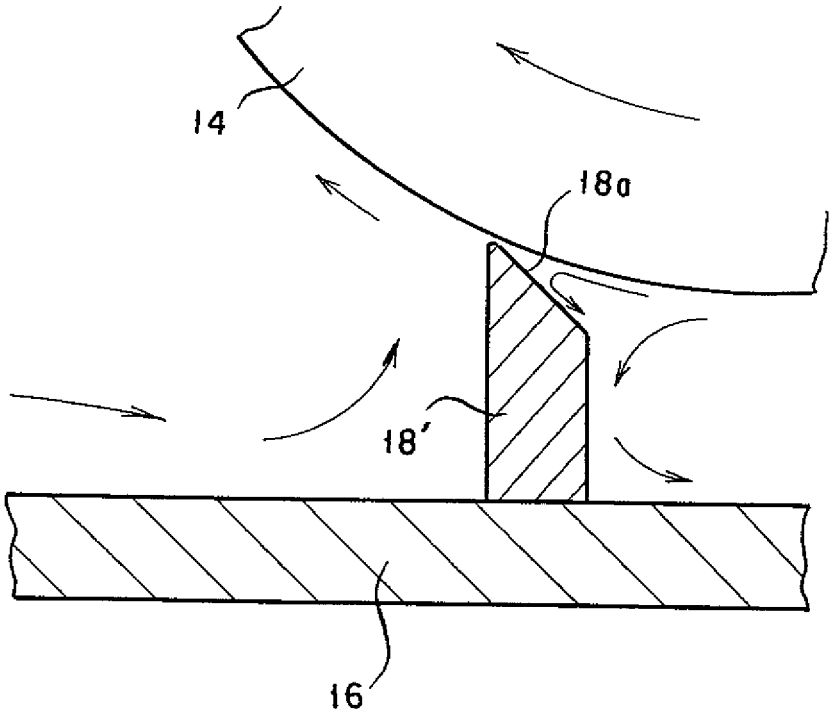
FIG. 5 is an enlarged cross sectional view illustrating another embodiment of the partition.

While in the form of implementation described above the partition plate 18 is shown having the liquid developer supply nozzle 19 at its top, it may as shown in FIG. 5 be a partition plate 18' lacking in the liquid developer supply passage. In this case, a liquid developer inlet port 20' as shown by chain lines in FIG. 2 is formed through a wall of the liquid developer tank 16 that is upstream of the partition plate 18'.

While the form of implementation described above the liquid developer supply roller 14 and the developing roller 13 are shown to be directly in rotational contact with each other, in taking account of the efficiency of delivery of the liquid developer between the liquid developer supply roller 14 and the developing roller 13, an intermediate roller not shown may be interposed between the liquid developer supply roller 14 and the developing roller 13. Then, the intermediate and developing rollers may be driven by a single motor to rotate at an identical peripheral speed while being controlled so as to rotate at their peripheral speeds varied slightly or so as to give a slight difference in peripheral speed between the intermediate and developing rollers to adjust the amount or rate of feed of the liquid developer.

What is claimed is:

1. A wet type developing apparatus in which a liquid developer is fed onto a developing roller from a liquid developer supply roller immersed in the developing liquid within a liquid developer tank and an electrostatic latent image formed on a photoconductor drum is developed into a toner image by said developing roller, the apparatus comprising:

a partition plate disposed generally under the liquid developer supply roller in the liquid developer tank for partitioning the liquid developer tank into two in a rotational direction of the liquid developer supply roller, the partition plate having an upper end juxtaposed with a peripheral surface of the liquid developer supply roller over its total axial length across a gap spacing between 0.05 and 0.5 mm;

wherein a peripheral speed of the liquid developer supply roller is adjustably varied relative to a peripheral speed of the developing roller to make adjustable a thickness of a film of the liquid developer fed onto the developing roller and to maintain the thickness of the film between 3 and 4.8 μm.

2. The wet type developing apparatus as set forth in claim 1, wherein an upper end portion of the partition plate is formed on its side upstream in the rotational direction of the liquid developer supply roller with a sloping face facing the peripheral surface of the liquid developer supply roller so as to be gradually apart therefrom.

3. The wet type developing apparatus as set forth in claim 2, wherein the upper end portion of the partition plate is formed with a liquid developer supply nozzle for flushing the liquid developer towards the peripheral surface of the liquid developer supply roller over its total axial length.

4. The wet type developing apparatus as set forth in claim 1, wherein the upper end of the partition plate is formed with a liquid developer supply nozzle for flushing the liquid developer towards the peripheral surface of the liquid developer supply roller over its total axial length.

5. A wet type developing apparatus in which a liquid developer is fed onto a developing roller from a liquid developer supply roller immersed in the developing liquid within a liquid developer tank and an electrostatic latent image formed on a photoconductor drum is developed into a toner image by said developing roller, the apparatus comprising:

a partition plate disposed generally under the liquid developer supply roller in the liquid developer tank for partitioning the liquid developer tank into two in a rotational direction of the liquid developer supply roller, the partition plate having an upper end juxtaposed with a peripheral surface of the liquid developer supply roller over its total axial length across a gap spacing between 0.05 and 0.5 mm;

wherein the upper end of the partition plate is formed with a liquid developer supply nozzle for flushing the liquid developer towards the peripheral surface of the liquid developer supply roller over its total axial length.

* * * * *